United States Patent [19]

Bennett et al.

[11] 4,129,416

[45] Dec. 12, 1978

[54] PROCESS FOR SHRINKING NYLON FABRICS

[75] Inventors: Roxanne L. Bennett, Mountville; James A. Tshudy, Ephrata, both of Pa.

[73] Assignee: Armstrong Cork Company, Lancaster, Pa.

[21] Appl. No.: 810,852

[22] Filed: Jun. 28, 1977

[51] Int. Cl.[2] ..... B05D 5/00; D06M 3/16

[52] U.S. Cl. ..... 8/115; 8/1 XB; 8/17; 8/DIG. 21; 8/130.1; 26/69 A

[58] Field of Search ..... 8/115, 1 XB, 17, DIG. 21, 8/130.1; 26/69 A

[56] References Cited

U.S. PATENT DOCUMENTS

| | | | |
|---|---|---|---|
| 2,365,931 | 12/1944 | Benger | 8/DIG. 21 X |
| 3,849,157 | 11/1974 | Palmer et al. | 8/17 |
| 3,849,158 | 11/1974 | Palmer et al. | 8/17 |
| 3,849,159 | 11/1974 | Palmer et al. | 8/17 |
| 3,901,649 | 11/1975 | Gregorian | 8/115 X |
| 3,953,164 | 4/1976 | Boba et al. | 8/115 |

FOREIGN PATENT DOCUMENTS

| | | | |
|---|---|---|---|
| 479262 | 12/1951 | Canada | 8/DIG. 21 |
| 544820 | 4/1942 | United Kingdom | 8/DIG. 21 |
| 574785 | 1/1946 | United Kingdom | 8/DIG. 21 |
| 582522 | 11/1946 | United Kingdom | 8/DIG. 21 |
| 813289 | 5/1959 | United Kingdom | 8/DIG. 21 |

*Primary Examiner*—John Kight, III

[57] ABSTRACT

The longitudinal contraction of fibers of nylon in textile fabrics is caused by the application of a nylon textile fabric contracting agent. The agent comprises a mixture of ammonium or a metal nitrate; an acid selected from the group inorganic acid, organic carboxylic acid, sulfonic acid, and mixtures thereof; and a halo, carbocyclic aryl, carbocyclic aryloxy or alkoxy substituted aliphatic alcohol. The textile fabric is treated with the contracting agent and heated to a temperature of from about 200° F. to about 400° F., to initiate a longitudinal contraction of the treated portions of the nylon fabric. After removal of substantially all of the textile fabric treating agent, the textile fabric is dried, thereby completing the longitudinal contraction.

15 Claims, No Drawings

PROCESS FOR SHRINKING NYLON FABRICS

BACKGROUND OF THE INVENTION

1. Field of the Invention

The present invention relates to a method of treating certain synthetic textile materials such as filaments, fibers, yarns, and threads, more especially in pile form, so as to cause the longitudinal contraction of these materials, and of the resulting products.

2. Description of the Prior Art

Embossing of pile fabrics is conventionally accomplished by utilizing a hot embossing roll or plate having engraved thereon various designs or patterns. The hot embossing roll, in contact with a pile fabric, causes a certain shrinking of the fabric, thereby creating the desired decorative embossed effect.

Various techniques have been conceived so as to eliminate the disadvantageously expensive embossing roll. One of the most successful techniques for such has been that generally described as a chemical embossing method. Recently chemical embossing techniques for nylon pile fabric have been disclosed in a number of United States patents. In U.S. Pat. No. 3,849,157, such chemical embossing technique is described to occur by the application of an embossing composition comprising a liquid base vehicle blended with a metal halide and an acid. U.S. Pat. No. 3,849,158 discloses that various azoles can be substituted for such metal halide to achieve equivalent chemical embossing. Other related disclosures can be found in U.S. Pat. Nos. 3,849,159 and 3,953,164.

While the processes of the prior art result in sufficient embossing of nylon fabric so as to achieve the desired results, in order to achieve a satisfactory depth of embossing, high concentrations of the embossing composition must be used. These high concentrations require various protective devices to provide adequate safety for those working in these operations. Further, in order to avoid environmental damage, the reagents used in the embossing treatment should be recovered, such recovery adding significantly to the cost of the actual process. Attempts to obviate these problems by the use of low concentration, less harmful or disposable chemical systems do not result in satisfactory embossing.

Further, as a result of the high concentrations of reagents necessary to give the desired effects in commercially acceptable production times, residual salts and, in some cases, polymeric residues appear on the surface of the treated fabrics, detracting from the overall aesthetics of the final pile materials.

SUMMARY OF THE INVENTION

It is an object of the present invention to provide a process for causing nylon fibers, fabric, and the like to contract in a longitudinal direction.

It is an additional object of the present invention to provide such a process wherein the longitudinal contraction of the pile fabrics is initiated, and subsequent to such initiation, contraction may be finished at a later time.

It is a further object of the present invention to provide a process whereby a dyed nylon-containing pile fabric is contacted with a chemical contracting reagent thereby causing a contraction in the nylon fabric and a haloing of the dye in the areas contacted by such reagent.

Another object of the present invention is to provide a process wherein a nylon-containing pile fabric has applied thereto, in selective areas, a chemical composition that results in the embossing of such selected areas.

These and other objects of the present invention will become more apparent by the following detailed description thereof.

It has now been discovered that it is possible to cause the longitudinal contraction of fibers of nylon in textile fabrics containing such nylon fibers by contacting selected portions of the textile fabrics with a nylon textile fabric contracting agent. By nylon containing textile fabric is meant fabric prepared solely from various nylon fibers, filaments, and the like or mixtures of nylon fiber with other fiber, such as, for example polyester (illustrated by polyethylene terephthalate). The agent, comprising a composition of ammonium or metal nitrates; an acid selected from the group inorganic acid, organic carboxylic acid, sulfonic acid, and mixtures thereof; and a halo, aryl, aryloxy- or alkoxy-substituted aliphatic alcohol dispersed or dissolved in a suitable carrier such as water is applied to selective portions of the pile fabric and the resulting treated fabric is heated from about 200° F. to about 400° F. for a period sufficient to initiate the longitudinal contraction of the textile fabric. After such heat treatment, substantially all of the contracting agent is removed from such fabric, resulting in a wet or damp material. Final contraction is completed by drying.

The depth of the contracted areas can be controlled by varying the concentration and/or the type of contracting agent as well as the quantity of contracting agent applied to the fabric.

The process in accordance with the present invention is carried out stepwise by (1) first applying to defined areas of a nylon-containing pile fabric surface a chemical longitudinal contracting agent for the fibers forming the nylon pile, the contracting agent comprising
   (a) ammonium or a metal nitrate;
   (b) an acid selected from the group inorganic acid, organic carboxylic acid, sulfonic acid and mixtures thereof; and
   (c) a halo, aryl, aryloxy or alkoxy substituted aliphatic alcohol or mixtures thereof;
(2) heating said fabric of step (1) to a temperature of from about 200° F. to about 400° F. for a period sufficient to initiate longitudinal contraction of the treated areas of said fabric;
(3) removing substantially all of the contracting agent thereby resulting in a moist nylon pile fabric;
(4) further longitudinally contracting said fibers by drying said fabric.

As a result of this four-step treatment, reagent chemicals are removed early in the contracting operation. Subsequent overprinting, dyeing and the like can thereby be readily accomplished before final contraction of the fibers occurs without consideration related to chemical or physical interaction of the contracting agent and dye or print paste.

DESCRIPTION OF THE PREFERRED EMBODIMENTS

It is well recognized that nylon filaments, fibers, yarns, threads, and the various products made from them, can be shrunk and even dissolved by contacting them with suitable reagents. In the pile fabric in accordance with the present invention, such is prepared from synthetic linear polyamides. Examples of such are those obtained from polymerizable monoaminocarboxylic acids and their amide-forming derivatives including caprolactam and those obtained from the reaction of suitable diamines with suitable dicarboxylic acids or their amide-forming derivatives. These "nylons" are more particularly set forth in, for example, U.S. Pat. No. 3,849,103 incorporated herein by reference.

The nylon textile fabric contracting agent, sometimes referred to herein as "contracting agent," is formed from a mixture of common chemical compounds that, when applied to a nylon fabric, produces a longitudinal contraction of the fibers of such fabric without causing any significant deterioration in either the chemical or physical properties of the treated fabric.

In order to be applicable to a wide variety of nylon fabrics such as, for example, pile fabrics used in carpet-making applications, the longitudinal contraction should not affect any subsequent or earlier treatments of such fabric, such as printing, dyeing, and the like. As such, the contracting agent should be compatible with any dyes or coloring agents used in the printing or otherwise coloring of the fabric materials, thereby allowing the printing and initial contracting to be done at one time. As a result of the novel process in accordance with the present invention, it is possible to remove the contracting agent by washing. Very little contracting of the nylon occurs at this stage. Overprinting the initial pattern with dye and/or contracting agent may now be readily carried out, resulting in a variety of decorative effects incorporating various colors and patterns. When dry, the embossing (contraction) of the pile becomes apparent.

The contracting agent, in the process of the present invention, is applied to the nylon fabric in any desired design, usually by screen printing. However, other conventional printing techniques can also be used, such as block printing. It is advantageous to apply the contracting agent as part of the dye composition utilized for printing of the nylon fabric. Often, thickeners such as gums and other derivatives are included so as to obtain desirable viscosity characteristics and other processing advantages.

It has been found advantageous that, when applied to the nylon textile fabric, the contracting agent be soluble in the medium from which it is applied. However, the contracting agent may also be applied as an emulsion. The only requirement in this respect is that the contracting agent should be of such a form as to be readily acceptable by the processing equipment in which it is utilized, e.g. it should readily pass through a screen if screen printing is used.

As previously indicated, the preferred contracting agent in accordance with the present invention is one which preliminarily initiates a contracting effect. After removal of such agent from the nylon fabric, such contraction can be finished at a later time by merely drying the fabric. Contracting agents which can function in this manner on nylon fabric, producing contraction of such nylon fabric, comprise ammonium or metal nitrates such as calcium nitrate, in combination with an acid selected from the group consisting of inorganic acid such as hydrochloric acid, organic carboxylic acid such as acetic acid, sulfonic acid such as sulfamic acid, or mixtures thereof, and a halo, $C_6$ to $C_{14}$ carbocyclic aryl, $C_6$ to $C_{14}$ carbocyclic aryloxy, or $C_1$ to $C_4$ alkoxy substituted $C_1$ to $C_4$ linear or branched aliphatic alcohol illustrated by, for example, 1-chloro-2-propanol, benzyl alcohol, 2-phenoxyethanol, or 2-butoxyethanol. The above components are advantageously used in combination with a water-containing disperse phase, for example, water itself or water admixed with an organic solvent such as methanol. When this combination of agents is applied to the nylon fabric, either prior to dyeing, subsequent to dyeing, or in the dye print paste itself, in the proper concentrations and proportions, the dried fibers of the nylon fabric contacted therewith are longitudinally contracted without significant deterioration. When used in combination with the dye print paste, such longitudinal contraction occurs exactly in register with the printed design. While the preferred salt is calcium nitrate, ammonium nitrate, lithium nitrate, aluminum nitrate, magnesium nitrate, zinc nitrate, copper (II) nitrate, iron (II) nitrate, tin (II) nitrate, and chromium nitrate are also of use herein. Similarly, while sulfamic and acetic acids are the preferred acids, other acids may be used in these contracting compositions such as phosphoric, formic, oxalic, malonic, tartaric, lactic, malic, citric, maleic, hydrochloric, sulfuric, propionic, hydroxyacetic, and benzenesulfonic acids. Rather than the acids themselves, anhydrides of such acids may also be used. In cases where these anhydrides are employed, it has been found advantageous to have water present in the contracting agent. Examples of such anhydrides include sulfur trioxide, phosphorous pentoxide, acetic anhydride, maleic anhydride, and the like. As indicated earlier, the preferred alcohols are 1-chloro-2-propanol, 2-phenoxyethanol, and benzyl alcohol. However, other alcohols are also useful herein, such including 1-ethoxy-2-propanol, 2,3-dibromopropanol, 2-butoxy ethanol, phenyl-n-propanol, 1,3-dichloro-2-propanol, 2-bromo-2-propanol, 2,2,2-trichloro-1-ethoxy ethanol, and the like. While any of the above components used individually or combined with some of the other components will achieve a certain amount of longitudinal contraction of the nylon fibers, when used in combination, an advantageous longitudinal contraction occurs that in some cases is greater than 70%. The extent of such longitudinal contraction, however, is chosen on the basis of the type of embossing or pattern desired on the nylon fabric material and is determined by the type, concentration, and amount of contracting agent applied to the fabric. As such, contractions of 20% in longitudinal length are of use. By controlling the amount of the above constituents of the formulation, the range in contraction can be varied from about 20% to over 70%.

As a second step in achieving the longtudinal contraction, the fabric treated in selected areas with the above composition is subjected to a temperature of 200° F. to about 400° F. for a period sufficient to initiate contraction of the nylon fabric in the selected areas. The heat required to initiate such contraction can be in the form of infrared heaters or steam, such as commonly generated in a "steam box" familiar to those skilled in the art of carpet productions. The presence of steam or any moisture in initiating such contraction is not essential to activate the longitudinal contraction, however.

The heating of the treated fabric can be for any length of time sufficient to cause initial contraction. At the higher temperature, e.g. 400° F., the treating time is shorter, such as ½ minute, than that of the lower temperature, e.g. 200° F., such being about 14 minutes. While longer times of heating can occur, such are usually economically disadvantageous, not being required to achieve satisfactory contraction of the individual fibers.

Preferably saturated steam (212° F.) is used to heat the treated fabric.

The use of the contracting agent to initiate the longitudinal contraction is only achieved, as indicated above, when the fabric having such fluid contacting it is subjected to heat. The contracting fluid can remain in contact with such nylon fabric either before or after the heat treatment for substantial lengths of time, e.g. from about 1 to about 30 minutes, without causing any deleterious effect on the fabric itself. Advantageously, however, the treating agent should be substantially removed from the textile fabric immediately after the heat treatment by washing such fabric with water and detergents. The washing action eliminates substantially any residual amounts of contracting agent which could contribute undesirable properties in the finished fabric such as odor, toxicity, color degradation, and texture changes. Since acidic components of the contracting agent are present, it is advantageous to utilize as a washing fluid an aqueous ammonia or mildly alkaline aqueous solution. This neutralization greatly facilitates the total removal of the contracting agent.

The above washing step results in a fabric having some small initial longitudinal contraction of fiber length, the fabric being in a state defined as wet or damp. At this point in the process, the contraction is not yet completed and the surface of the fabric has not been modified to the extent that further printing and processing cannot be carried out. Thus, the process herein is unexpectedly advantageous in that it is quite possible to further color, print, and emboss the resulting nylon fabric so as to achieve further color or embossing variations. The longitudinal contraction, not being completed, gives a fabric surface that has not been altered significantly so as to preclude further printing and processing.

No further contraction of the textile fibers occurs until the final step of the process in accordance with the present invention. This final step is the drying of the damp fabric of the above step by either ambient air or heat so as to yield a final textile fabric that is of a low moisture content, i.e. dry to the touch, and fully embossed as desired. While oven or hot air drying may be used, ambient air drying is preferable from economic considerations.

The nylon textile fabric contracting agent is used within approximately the following broad range of concentrations for each of the components so as to obtain a nylon textile fabric contraction of satisfactory amount. These ranges represent percents of each of the components in a total agent composition:

Metal nitrate : 4%–70%
Acid : 4%–70%
Aliphatic alcohol : 1%–60%

By varying the above concentrations, it is possible for one skilled in the art to develop specific combinations that would be most effective for any of the textile fabrics being treated. For example, in the treatment of nylon pile fabric, concentrations of calcium nitrate, benzyl alcohol, and sulfamic acid are generally selected from within the approximate following narrower ranges:

Calcium nitrate: 20%–40%
Sulfamic acid : 3%–20%
Benzyl alcohol : 5%–20%

The remainder of the composition being a liquid carrier vehicle.

The above compositions can be used as such or diluted with various solvents or dispersing fluids. As such, it may be dispersed in the print paste or dissolved in a solvent such as methanol. When used in solvent or dispersed form, the total concentrations of all of the above should fall within the range of 9% to 90%. Uses below this percentage level generally do not result in satisfactory embossing without excessive temperature treatment. To exceed these limits, a general undesirable fusion (flowing together) or degradation of the nylon filaments may occur. However, by a proper balancing of the components of the composition in the high concentration ranges, maximum contraction results can be achieved without fusion but with the additional feature of haloing of the dye in the fabric adjacent to those areas where the contracting agents have been applied. By "haloing" is meant the diminution of dye color in and nearby to areas of fabric treated with the contracting composition. Color diminution is greatest in the areas treated, the effect gradually disappearing as the distance from those areas increases, an effect much like a halo results. Thus, various pleasing styles of carpet embossing designs are possible.

The viscosity of the contracting agent, or print paste-contracting agent combination, is an important factor in the final embossing to be expected on a pile fabric. The viscosity of the agent will determine the amount of agent deposited on the fabric under specific printing conditions, which will, in turn, effect the final embossing achieved. The viscosity, also, effects the degree of penetration of the agent into the pile which significantly effects the overall embossing achieved. Maximum effectiveness is achieved by applying a sufficient though not excessive quantity of contracting agent to the fabric and permitting or causing it to completely penetrate into the pile. Control of the viscosity and selection of the appropriate application technique are the means by which one skilled in the art can achieve the desired result.

As a further embodiment in the present invention, salts formed from the combination of a weak acid and a strong base, a strong acid and a weak base or a weak acid and a weak base when added to the contracting agent result in a composition that is effective in causing the contracting of nylon filaments, yarns, and the like, but controlling or preventing the diminution in the color density of the dyed materials e.g., inhibiting the above disclosed haloing effect. Those skilled in the art recognize a class of materials falling into the above salt groups such being generally defined as electrolytes (substances that when dissolved in water or other solvents of high dielectric constant yield solutions that conduct an electric current). The above salts are further characterized by being weak electrolytes, e.g. electrolytes that are slightly ionized in solution, otherwise known as weak salts. These weak salts, when added to the contracting composition in as little as about 0.1% by weight of contracting composition to about 25% by weight of such composition, inhibit or prevent the haloing effect with no appreciable lessening of the effect of the contracting solution. Preferably these salts are used at concentrations of 1%–10% by weight, most preferably 2%–5% by weight.

In the following examples, a testing procedure described in the prior art for preliminarily determining the ability of the chemical composition to shrink nylon fibers is employed. Using this test, the percent shrinkage of a 50 centimeter loop of nylon carpet filament or yarn is determined by immersing the loop in a solution or dispersion of the test chemical for 15 minutes at 215° F. (102° C.). Details of the test are as follows:

BEAKER TEST PROCEDURE

1. A solution or dispersion of the fabric contracting agent to be tested is prepared using water as a diluent. Thirty grams of such fluid at 25° C. are weighed into a 32 × 200 millimeter test tube.

2. The test tube is immersed in a constant temperature bath set at 215° F. (102° C.).

3. A 1 meter length of nylon yarn or filament preconditioned at 73° F. and 50% relative humidity for 24 hours is tied in a single loop.

4. The above loop is prestressed for 30 seconds using a 50 gram load and the length of the loop measured to the nearest 0.1 centimeter.

5. The nylon loop is immersed in the contracting fluid at 215° F., agitated gently and observed over a period of 15 minutes.

6. The nylon loop is removed and washed thoroughly with water.

7. After blotting and drying to constant weight at 73° F. and 50% relative humidity, the loop is measured as in step 4. The percent shrinkage is obtained by dividing the length change of the loop after treatment by the length of the loop before treatment times 100%.

The above test procedure has been used in U.S. Pat. No. 3,849,157 through U.S. Pat. No. 3,849,159 as acceptably predicting, whether or not a chemical composition has any potential as an embossing agent, e.g. an agent that will cause the longitudinal contraction. While these latter patents note some differences between treating a loop and treating an entire fabric, the disclosures clearly show that the results obtained by the beaker test are confirmed in practice on textile materials.

The following examples further illustrate the embodiments of this invention. In these examples, all concentrations are in moles unless otherwise noted.

EXAMPLE 1

The contraction experienced by a test loop of Dupont Type 856 bulk continuous filament Nylon 6/6 (1225 denier, 80 filaments, 0 twist and semidull regular acid dyeable) was determined by means of the beaker test procedure described earlier using the concentrations shown in Tables I, II, and III at a test temperature of 215° F. and a test time of 15 minutes.

Table I

Effect of Acid Type & Concentration on Nylon Yarn Longitudinal Contraction

| Example | | Components of Contracting Formulation | Moles Salt | Moles Acid | Moles $H_2O$ | Moles Benzyl Alcohol | % Length Change |
|---|---|---|---|---|---|---|---|
| Comparative | 1 | $CaCl_2$, formic acid, $H_2O$ | .136 | .435 | 3.60 | 0 | −16.9 |
| | 1 | $Ca(NO_3)_2$, formic acid, $H_2O$, benzyl alcohol | .136 | .435 | 3.60 | .025 | −35.9 |
| Comparative | 2 | $CaCl_2$, glacial acetic acid, $H_2O$ | .136 | .333 | 3.60 | 0 | −16.5 |
| | 2 | $Ca(NO_3)_2$, glacial acetic acid, $H_2O$, benzyl alcohol | .136 | .333 | 3.60 | .025 | −29.2 |
| Comparative | 3 | $CaCl_2$, oxalic acid, $H_2O$ | .068 | .032 | 4.97 | 0 | −12.7 |
| | 3 | $Ca(NO_3)_2$, oxalic acid, $H_2O$, benzyl alcohol | .068 | .032 | 4.97 | .025 | −16.3 |
| Comparative | 4 | $CaCl_2$, malonic acid, $H_2O$ | .136 | .192 | 3.60 | 0 | −15.5 |
| | 4 | $Ca(NO_3)_2$, malonic acid, $H_2O$, benzyl alcohol | .136 | .192 | 3.60 | .025 | −31.1 |
| Comparative | 5 | $CaCl_2$, malonic acid, $H_2O$ | .204 | .240 | 2.90 | 0 | −42.9 |
| | 5 | $Ca(NO_3)_2$, malonic acid, $H_2O$, benzyl alcohol | .204 | .240 | 2.90 | .025 | Dis. |
| Comparative | 6 | $CaCl_2$, glycolic acid, $H_2O$ | .170 | .329 | 3.12 | 0 | −13.8 |
| | 6 | $Ca(NO_3)_2$, glycolic acid, $H_2O$, benzyl alcohol | .170 | .329 | 3.12 | .025 | Dis. |
| Comparative | 7 | $CaCl_2$, glycolic acid, $H_2O$ | .170 | .263 | 3.40 | 0 | −6.9 |
| | 7 | $Ca(NO_3)_2$, glycolic acid, $H_2O$, benzyl alcohol | .170 | .263 | 3.40 | .025 | Dis. |
| Comparative | 8 | $CaCl_2$, lactic acid, $H_2O$ | .170 | .278 | 3.12 | 0 | −13.0 |
| | 8 | $Ca(NO_3)_2$, lactic acid, $H_2O$, benzyl alcohol | .170 | .278 | 3.12 | .025 | −27.7 |
| Comparative | 9 | $CaCl_2$, malic acid, $H_2O$ | .170 | .186 | 3.12 | 0 | −13.0 |
| | 9 | $Ca(NO_3)_2$, malic acid, $H_2O$, benzyl alcohol | .170 | .186 | 3.12 | .025 | Dis. |
| Comparative | 10 | $CaCl_2$, tartic acid, $H_2O$ | .170 | .166 | 3.12 | 0 | −13.7 |
| | 10 | $Ca(NO_3)_2$, tartaric acid, $H_2O$, benzyl alcohol | .170 | .166 | 3.12 | .025 | Dis. |
| Comparative | 11 | $CaCl_2$, citric acid, $H_2O$ | .170 | .119 | 3.24 | 0 | −15.5 |
| | 11 | $Ca(NO_3)_2$, citric acid, $H_2O$, benzyl alcohol | .170 | .119 | 3.24 | .025 | Dis. |
| Comparative | 12 | $CaCl_2$, citric acid, $H_2O$ | .204 | .143 | 2.77 | 0 | −35.2 |
| | 12 | $Ca(NO_3)_2$, citric acid, $H_2O$, benzyl alcohol | .204 | .143 | 2.77 | .025 | Dis. |
| Comparative | 13 | $CaCl_2$, maleic acid, $H_2O$ | .136 | .172 | 3.60 | 0 | −27.0 |
| | 13 | $Ca(NO_3)_2$, maleic acid, $H_2O$, benzyl alcohol | .136 | .172 | 3.60 | .025 | Dis. |
| Comparative | 14 | $CaCl_2$, sulfamic acid, $H_2O$ | .136 | .103 | 4.16 | 0 | −13.0 |
| | 14 | $Ca(NO_3)_2$, sulfamic acid, $H_2O$, benzyl alcohol | .136 | .103 | 4.16 | .025 | −29.8 |
| Comparative | 15 | $CaCl_2$, sulfamic acid, $H_2O$ | .204 | .103 | 3.74 | 0 | −14.4 |
| | 15 | Ca(NO hd 3)$_2$, sulfamic acid, $H_2O$, benzyl alcohol | .204 | .103 | 3.74 | .025 | −40.0 |
| | 16 | $Ca(NO_3)_2$, sulfamic acid, $H_2O$, benzyl alcohol | .204 | .103 | 3.74 | .050 | F |

Table II

Effect of Salt Type and Concentration on Nylon Yarn Longitudinal Contraction

| Example | | Components of Contracting Formulation | Moles Salt | Moles Acetic Acid | Moles $H_2O$ | Moles Benzyl Alcohol | % Length Change |
|---|---|---|---|---|---|---|---|
| Comparative | 17 | $CuCl_2$, HAc*, $H_2O$ | .147 | .417 | 3.07 | 0 | −29.0 |
| | 17 | $Cu(NO_3)_2$, HAc, $H_2O$, benzyl alcohol | .147 | .417 | 3.07 | .025 | Dis. |
| Comparative | 18 | $FeCl_3$, HAc, $H_2O$ | .074 | .333 | 3.77 | 0 | −32.5 |
| | 18 | $Fe(NO_3)_3$, HAc, $H_2O$, benzyl alcohol | .074 | .333 | 3.77 | .025 | Dis. |
| Comparative | 19 | LiCl, HAc, $H_2O$ | .590 | .417 | 2.78 | 0 | −32.5 |
| | 19 | $LiNO_3$, HAc, $H_2O$, benzyl alcohol | .590 | .417 | 2.78 | .025 | Dis. |
| Comparative | 20 | KCl, HAc, $H_2O$ | .402 | .500 | 2.78 | 0 | −11.8 |
| | 20 | $KNO_3$, HAc, $H_2O$, benzyl alcohol | .402 | .500 | 2.78 | .025 | −20.6 |
| Comparative | 21 | NaCl, HAc, $H_2O$ | .342 | .417 | 3.06 | 0 | −13.7 |
| | 21 | $NaNO_3$, HAc, $H_2O$, benzyl alcohol | .342 | .417 | 3.06 | .025 | −22.1 |
| Comparative | 22 | $AlCl_3$, HAc, $H_2O$ | .1035 | .417 | 3.40 | 0 | −35.5 |
| | 22 | $Al(NO_3)_3$, HAc, $H_2O$, benzyl alcohol | .1035 | .417 | 3.40 | .025 | Dis. |
| Comparative | 23 | $CaCl_2$, HAc, $H_2O$ | .170 | .500 | 2.84 | 0 | −40.3 |
| | 23 | $Ca(NO_3)_2$, HAc, $H_2O$, benzyl alcohol | .170 | .500 | 2.84 | .025 | F |
| Comparative | 24 | $ZnCl_2$, HAc, $H_2O$ | .183 | .333 | 3.05 | 0 | −46.5 |

Table II-continued

| Example | | Components of Contracting Formulation | Moles Salt | Moles Acetic Acid | Moles $H_2O$ | Moles Benzyl Alcohol | % Length Change |
|---|---|---|---|---|---|---|---|
| | | Effect of Salt Type and Concentration on Nylon Yarn Longitudinal Contraction | | | | | |
| | 24 | $Zn(NO_3)_2$, HAc, $H_2O$, benzyl alcohol | .183 | .333 | 3.05 | .025 | Dis. |
| | 25 | $Zn(NO_3)_2$, HAc, $H_2O$, benzyl alcohol | .1835 | .417 | 2.78 | .025 | Dis. |
| | 26 | $Zn(NO_3)_2$, HAc, $H_2O$, benzyl alcohol | .147 | .333 | 3.33 | .025 | −745.7 |
| | 27 | $Zn(NO_3)_2$, HAc, $H_2O$, benzyl alcohol | .1835 | .333 | 3.05 | .050 | Dis. |
| Comparative | 28 | $NH_4Cl$, HAc, $H_2O$ | .271 | .417 | 3.33 | 0 | −12.7 |
| | 28 | $NH_4NO_3$, HAc, $H_2O$, benzyl alcohol | .271 | .417 | 3.33 | .025 | −18.1 |

*HAc = glacial acetic acid
F = fused
Dis = disintegrated

Table III

| Example | | Components of Embossing Formulation | Composition of Embossing Formulation: Moles Nitrate | Moles Acid | Moles $H_2O$ | Moles Benzyl Alcohol | % Length Change |
|---|---|---|---|---|---|---|---|
| | | Effect of Substituted Alphatic Alcohol and Concentration on Shrinkage | | | | | |
| Comparative | 29 | $Ca(NO_3)_2$, $H_2O$, HAc | .170 | .417 | 3.12 | 0 | −31.4 |
| | 29 | $Ca(NO_3)_2$, $H_2O$, HAc, benzyl alcohol | .170 | .417 | 3.12 | .0125 | −39.8 |
| | 30 | $Ca(NO_3)_2$, $H_2O$, HAc, benzyl alcohol | .170 | .417 | 3.12 | .025 | −49.7 |
| | 31 | $Ca(NO_2)_2$, $H_2O$, HAc, benzyl alcohol | .170 | .417 | 3.12 | .050 | −71.2 |
| | 32 | $Ca(NO_3)_2$, $H_2O$, HAc, benzyl alcohol | .170 | .417 | 3.12 | .100* | F |
| | 33 | $Ca(NO_3)_2$, HAc, $H_2O$, 2-phenoxyethanol | .170 | .417 | 3.12 | .050 | −65.5 |
| | 34 | $Ca(NO_3)_2$, HAc, $H_2O$, 2,3-dibromopropanol | .170 | .417 | 3.12 | .050 | −73.2 |
| | 35 | $Ca(NO_3)_2$, HAc, $H_2O$, 1-chloro-2-propanol | .170 | .417 | 3.12 | .050 | −45.7 |
| | 36 | $Ca(NO_3)_2$, HAc, $H_2O$, 1-ethoxy-2-propanol | .170 | .417 | 3.12 | .050 | −46.5 |
| | 37 | $Ca(NO_3)_2$, HAc, $H_2O$, 2-butoxy ethanol | .170 | .417 | 3.12 | .050 | −44.0 |
| | 38 | $Ca(NO_3)_2$, HAc, $H_2O$, 1-phenyl-n-propanol | .170 | .417 | 3.12 | .050 | −51.7 |
| | 39 | $Ca(NO_3)_2$, HAc, $H_2O$, 1,3-dichloro-2-propanol | .170 | .417 | 3.12 | .050 | −61.5 |
| | 40 | $Ca(NO_2)_2$, HAc, $H_2O$, 2,2,2-trichloro-1-ethoxy ethanol | .170 | .417 | 3.12 | .050 | −72.0 |
| | 41 | $Ca(NO_3)_2$, HAc, $H_2O$, 2,2,2-trichloro-1-ethoxy ethanol | .170 | .417 | 3.12 | .025 | −51.1 |
| | 42 | $Ca(NO_3)_2$, HAc, $H_2O$, 2,2,2-trichloro-1-ethoxy ethanol | .170 | .417 | 3.12 | .0125 | −47.5 |

*Required the addition of 1 gram methanol to render benzyl alcohol miscible with aqueous solution.

EXAMPLES 43–58

These examples illustrate the preparation of an embossed pile nylon carpet typical of the products produced by the process of this invention.

A 12 × 12 inches rectangular area of nylon carpet was treated by means of a screen printing technique with a dye paste containing the contracting compositions illustrated in Table IV. The carpet construction was as follows:

Type — 100% Nylon 6/6, spun yarn, non-heat set
Face weight — 28 oz/yd$^2$ (950 grams/square meter)
Machine guage — ⅛ inch (3.18 millimeters)
Machine stitch rate — 10.5 stitches/inch (4.1 stitches/cm)
Pile height — ¼ inch, singles (6.36 millimeters)

Carpet Embossing Procedure

1. Dye print paste screen-printed onto fabric;
2. Steam for 14 minutes at 212° F.;
3. Wash with water; and
4. Dry in oven at 235° F.

Time lapse between steps 1 & 2 and 2 & 3 about 1 minute.
Time to completion of drying is about 30–60 minutes.

Table IV

| Embossing of Nylon Carpet | | | | | | | | | | | | | | | | |
|---|---|---|---|---|---|---|---|---|---|---|---|---|---|---|---|---|
| Example | 43 | 44 | 45 | 46 | 47 | 48 | 49 | 50 | 51 | 52 | 53 | 54 | 55 | 56 | 57 | 58 |
| Water | 52.7 | 41.8 | 45.1 | 40.6 | 45.5 | 39.8 | 37.6 | 29.7 | 42.5 | 34.7 | 35.4 | 33.9 | 30.8 | 35.6 | 39.4 | 24.0 |
| [1]Natrosol 25OHHX | 0.4 | 0.7 | 0.3 | 0.3 | 0.3 | 0.3 | 0.3 | 0.2 | 0.3 | 0.4 | 0.3 | 0.3 | 0.6 | 0.4 | 0.3 | 0.3 |
| [2]Kelzan D | 0.2 | 0.2 | 0.2 | 0.2 | 0.2 | 0.2 | 0.2 | 0.1 | 0.1 | 0.1 | 0.1 | 0.1 | 0.1 | 0.1 | 0.1 | 0.1 |
| [3]Antifoam 73 | 0.6 | 0.9 | 1.0 | 0.9 | 1.0 | 0.9 | 0.7 | 0.3 | 0.4 | 0.3 | 0.4 | 0.3 | 0.7 | 0.3 | 0.4 | 0.4 |
| $Ca(NO_3)_2 \cdot 4H_2O$ | 23.2 | 33.6 | 35.4 | 32.7 | 34.9 | 32.1 | 29.7 | 23.9 | 25.0 | 21.2 | 28.0 | 26.7 | 24.3 | 28.0 | 40.4 | 50.0 |
| Benzyl alcohol | 11.4 | 11.3 | 6.0 | 14.2 | 11.7 | 10.8 | 10.0 | 8.0 | 1.5 | 12.8 | 4.7 | 9.0 | 16.3 | 13.0 | 15.2 | 20.0 |
| Acetic acid (glacial) | — | — | — | — | — | — | 16.1 | — | 30.0 | 29.7 | 30.4 | 29.0 | 26.4 | 21.8 | 4.0 | 5.0 |
| Sulfamic acid | 10.5 | 10.5 | 11.0 | 10.2 | 5.4 | 15.0 | 4.6 | — | — | — | — | — | — | — | — | |
| Hydroxyacetic acid | — | — | — | — | — | — | — | 29.7 | — | — | — | — | — | — | — | — |
| [4]Latyl Blue BGA | 1.0 | 1.0 | 1.0 | 0.9 | 1.0 | 0.9 | 0.8 | 0.7 | 0.2 | 0.8 | 0.7 | 0.7 | 0.8 | 0.8 | 0.2 | 0.2 |
| % Pile Shrinkage | 36 | 50 | 29 | 36 | 29 | 50 | 43 | 36 | 29 | 50 | 43 | 50 | 64 | 43 | 43 | 50 |
| [5]Pile Condition | | | | | | | | | | | | | | | | |
| Color | G | G | G | G | G | G | G | G | G | G | G | G | G | G | G | D |
| Strength | St | Sw | St | St | st | Sw | St | St | St | St | St | Sw | Sw | St | St | St |

Table IV-continued

| | Embossing of Nylon Carpet | | | | | | | | | | | | | | | |
|---|---|---|---|---|---|---|---|---|---|---|---|---|---|---|---|---|
| Example | 43 | 44 | 45 | 46 | 47 | 48 | 49 | 50 | 51 | 52 | 53 | 54 | 55 | 56 | 57 | 58 |
| Hand | S | G | S | G | G | G | S | S | S | G | S | G | H | G | G | H |

[1]Natrosol 250HHX - hydroxyethyl cellulose gum thickener, trademark of Hercules, Inc.
[2]Kelzan D - Xanthan gum thickener, trademark of Kelco, Inc.
[3]Antifoam 73 - 2-ethylhexanol, trademark Chemical Processing of Georgia Co.
[4]Latyl Blue - C.I. Disperse Blue 60
[5]D - Discolored
G - Good
St - Strong
Sw - Slight Weakening
S - Soft
H - Harsh
All figures are in parts by weight per hundred total composition.

tions on the embossing of the carpet and concerted inhibition of the haloing effect.

Table V

| | Haloing-Inhibited Weak Salt Contracting Composition | | | | | |
|---|---|---|---|---|---|---|
| | | | | Color[1] | | Properties | |
| Example | Contracting Formulation | | % Pile Shrinkage | Background | Embossed Area | Fiber Strength | Hand |
| 63 | Formulation of Example 59 | | 50 | NC | SC | Sl | Sl |
| 64 | " | +1% ammonium tartrate | 50 | NC | F | Sl | Sl |
| 65 | " | +5% ammonium tartrate | 50 | NC | G | St | S |
| 66 | " | +5% ammonium citrate | 36 | NC | F | St | Sl |
| 67 | " | +5% ammonium carbonate | 29 | NC | F | St | S |
| 68 | " | +5% calcium phosphate | 50 | NC | SC | Sl | S |
| 69 | " | +5% benzyl acetate | 50 | NC | SC | Sl | Sl |
| 70 | " | +5% sodium acetate | 43 | NC | G | St | S |
| 71 | " | + 5% sodium tartrate | 50 | NC | G | St | S |
| 72 | " | +5% sodium tetraborate | 43 | NC | G | St | S |
| 73 | " | +5% monosodium phosphate | 43 | Hl | SC | St | S |
| 74 | " | +5% disodium phosphate | 43 | NC | F | St | S |
| 75 | " | +5% trisodium phosphate | 36 | NC | G | St | S |
| 76 | " | +5% ammonium chloride | 50 | NC | G | Sl | S |
| 77 | " | +5% ammonium nitrate | 50 | Hl | SC | Sl | Sl |
| 78 | " | +5% sodium chloride | 43 | NC | SC | St | Sl |
| 79 | Formulation of Example 60 | | 43 | NC | SC | St | Sl |
| 80 | " | +0.5% sodium acetate | 29 | NC | SC | St | S |
| 81 | " | +5.0% sodium acetate | 14 | NC | G | St | S |
| 82 | " | +0.5% ammonium tartrate | 43 | NC | C | St | S |
| 83 | " | +5.0% ammonium tartrate | 29 | NC | G | St | S |
| 84 | Formulation of Example 61 | | 57 | Hl | SC | W | H |
| 85 | " | +5% sodium acetate | 36 | NC | SC | St | S |
| 86 | " | +10% sodium acetate | 36 | NC | G | St | S |
| 87 | Formulation of Example 62 | | 57 | Hl | SC | W | H |
| 88 | " | +20% sodium acetate | 14 | NC | G | St | S |

[1]NC - No change
Sl - Slight change
SC - Severe change
G - Good
F - Faded
St - Strong
S - Soft
Hl - Halo around embossed area
H - Harsh

EXAMPLES 59–88

To illustrate a further embodiment of the present invention, haloing-inhibited weak salt contracting compositions were prepared utilizing the following formulations:

| Example | 59 | 60 | 61 | 62 |
|---|---|---|---|---|
| Water | 34.1 | 44.2 | 34.2 | 34.9 |
| Acetic acid | 29.2 | — | — | — |
| Formic acid | — | 20.8 | 30.8 | — |
| Malonic acid | — | — | — | 26.2 |
| Natrosol 250HHX | 0.25 | 0.3 | 0.3 | 0.3 |
| Kelzan D | 0.1 | 0.1 | 0.1 | 0.1 |
| Antifoam 73 | 0.3 | 0.45 | 0.4 | 0.3 |
| $Ca(NO_3)_2 \cdot 4H_2O$ | 26.9 | 25.0 | 25.0 | 28.0 |
| Benzyl alcohol | 9.0 | 9.0 | 9.0 | 9.4 |
| Latyl Blue BGA | 0.15 | 0.15 | 0.2 | 0.8 |

The formulations were used in the procedure identical to that disclosed as illustrative of the embossing procedure of nylon carpet, Examples 43–58 (Table IV). The following table illustrates the effect of these composi-

What is claimed is:

1. A method for longitudinally contracting fibers of nylon in textile fabrics comprising the steps of:

(a) applying to defined areas of said textile fabric a nylon textile fabric contracting agent comprising
  (1) ammonium nitrate or a metal nitrate,
  (2) an inorganic acid, an organic carboxylic acid, an organic sulfonic acid, an anhydride of said acids or mixtures thereof, and
  (3) a halo, $C_6$ to $C_{14}$ carboxylic aryloxy or $C_1$ to $C_4$ linear or branched alkoxy substituted $C_1$ to $C_4$ linear or branched aliphatic alcohol or mixtures thereof;

(b) heating said fabric of step (a) to a temperature of from about 200° F. to about 400° F. for a period sufficient to initiate said longitudinal contraction of said fibers of nylon in said textile fabric;

(c) removing substantially all of the contracting agent from said textile fabric, thereby resulting in a wet textile fabric; and, (d) drying the textile fabric of step (c), thereby further longitudinally contracting said fibers of nylon in said textile fabric.

2. The method of claim 1, wherein said textile fabric contracting agent is selected from the group ammonium nitrate, calcium nitrate, lithium nitrate, aluminum nitrate, magnesium nitrate, zinc nitrate, copper (II) nitrate, iron (II) nitrate, tin (II) nitrate, and chromium nitrate, said acid is organic acid selected from the group acetic acid, formic acid, oxalic acid, malonic acid, tartaric acid, lactic acid, malic acid, citric acid, maleic acid, propionic acid, hydroxacetic acid, sulfamic acid, and benzenesulfonic acid, said aliphatic alcohol is selected from the group 1-chloro-2-propanol, 2-phenoxyethanol, benzyl alcohol, 1-ethoxy- 2-propanol, 2,3-dibromopropanol, 2-butoxy ethanol, phenyl-n-propanol, 1,3-dichloro-2-propanol, 2-bromo-2-propanol, and 2,2,2-trichloro-1-ethoxy ethanol.

3. The method of claim 1, wherein said contracting agent additionally comprises a salt formed from the combination of a weak acid and a strong base, a strong acid and a weak base, or a weak acid and a weak base, such salt in concentration of about 0.1% by weight to about 25% by weight of total contracting composition.

4. The method of claim 3, wherein said salt is selected from the group ammonium tartrate, ammonium citrate, ammonium carbonate, sodium acetate, sodium tartrate, sodium tetraborate, trisodium phosphate, ammonium chloride, and ammonium sulfamate.

5. The method of claim 1, wherein said heating is carried out from about 14 to about ½ minute.

6. The method of claim 1, wherein said contracting agent is incorporated in a vehicle therefor, said vehicle being a dye printing paste, and wherein after step (c) a further application to said textile fabric of said contracting agent is carried out.

7. The method of claim 1, wherein said drying is ambient air drying.

8. The method of claim 1, wherein said contracting agent is 20%–40% by weight calcium nitrate, 3%–20% by weight sulfamic acid, and 5%–20% by weight benzyl alcohol based on total weight of said contracting agent.

9. The method of claim 1 wherein said contracting agent is 20%–40% by weight aluminum nitrate, 3%–20% by weight acetic acid, and 5%–20% by weight 2-phenoxyethanol based on total weight of said contracting agent.

10. The method of claim 1 wherein said contracting agent is 20%–40% by weight zinc nitrate, 3%–20% by weight acetic acid, and 5%–20% by weight 2-phenoxyethanol based on total weight of said contracting agent.

11. The method of claim 1, wherein said textile fabric is a nylon pile fabric having a surface of nylon fibers.

12. A method for longitudinally contracting fibers of nylon in textile fabrics comprising the steps of:

(a) applying to defined areas of said textile fabric a nylon textile fabric contracting agent comprising
(1) 20%–40% calcium nitrate,
(2) 3%–20% sulfamic acid, and
(3) 5%–20% benzyl alcohol;

(b) heating said fabric of step (a) to a temperature of about 212° F. for a period sufficient to initiate said longitudinal contraction of said fibers of nylon in said textile fabric;

(c) removing substantially all of the contracting agent from said textile fabric, thereby resulting in a wet textile fabric; and, (d) drying the textile fabric of step (c), thereby further longitudinally contracting said fibers of nylon in said textile fabric.

13. The method of claim 12 wherein said contracting agent additionally comprises 2%–5% by weight ammonium tartrate based on weight of total contracting agent.

14. The method of claim 12 wherein said contracting agent additionally comprises 2%–5% by weight sodium acetate based on weight of total contracting agent.

15. A composition for contracting fibers of nylon in textile fabrics which comprises (a) ammonium nitrate or a metal nitrate;

(b) an inorganic acid, an organic carboxylic acid, an organic sulfonic acid, an anhydride of said acids, mixtures thereof; and, (c) a halo, $C_6$ to $C_{14}$ carbocyclic aryl, $C_6$ to $C_{14}$ carbocyclic aryloxy or $C_1$ to $C_4$ linear or branched alkoxy substituted $C_1$ to $C_4$ linear or branched aliphatic alcohol or mixtures thereof.

* * * * *

UNITED STATES PATENT AND TRADEMARK OFFICE

CERTIFICATE OF CORRECTION

PATENT NO. : 4,129,416

DATED : December 12, 1978

INVENTOR(S) : Roxanne L. Bennett et al

It is certified that error appears in the above-identified patent and that said Letters Patent are hereby corrected as shown below:

In the Specification:

Column 10, Table II, in the % Length Change column, for Comparative 26, "-745.7" should read ---45.7--.

Column 10, Table IV, under column 50, for Sulfamic acid, "—" should read --7.4--.

Column 12, Table V, in the Color[1] Embossed Area column, for Example 82, "C" should read --SC--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*

UNITED STATES PATENT AND TRADEMARK OFFICE

CERTIFICATE OF CORRECTION

PATENT NO. : 4,129,416

DATED : December 12, 1978

INVENTOR(S) : Roxanne L. Bennett et al.

It is certified that error appears in the above-identified patent and that said Letters Patent are hereby corrected as shown below:

In the Claims:

Claim 1, column 12, line 58, "(3) a halo, $C_6$ to $C_{14}$ carboxylic aryloxy or $C_1$ to $C_4$ linear or branched alkoxy substituted $C_1$ to $C_4$ linear or branched aliphatic alcohol or mixtures thereof;" should read --(3) a halo, $C_6$ to $C_{14}$ carbocyclic aryl, $C_6$ to $C_{14}$ carbocyclic aryloxy or $C_1$ to $C_4$ linear or branched alkoxy substituted $C_1$ to $C_4$ linear or branched aliphatic alcohol or mixtures thereof;--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*